US008656868B2

(12) United States Patent
Ungaro

(10) Patent No.: US 8,656,868 B2
(45) Date of Patent: Feb. 25, 2014

(54) HEAT EXCHANGER FOR THERMO BOILER

(76) Inventor: Antonio Ungaro, S. Mango D'Aquino (IT)

( * ) Notice: Subject to any disclaimer, the term of this patent is extended or adjusted under 35 U.S.C. 154(b) by 1038 days.

(21) Appl. No.: 12/668,644

(22) PCT Filed: Jul. 11, 2008

(86) PCT No.: PCT/IT2008/000467

§ 371 (c)(1),
(2), (4) Date: Jan. 11, 2010

(87) PCT Pub. No.: WO2009/008026

PCT Pub. Date: Jan. 15, 2009

(65) Prior Publication Data

US 2010/0180835 A1 Jul. 22, 2010

(51) Int. Cl.
*F28G 1/08* (2006.01)

(52) U.S. Cl.
USPC ..... 122/379; 122/22; 122/32; 122/34; 122/211; 122/367.4; 122/387

(58) Field of Classification Search
USPC ..... 122/32–34, 22, 211, 367.4, 379, 387
See application file for complete search history.

(56) References Cited

U.S. PATENT DOCUMENTS

| | | | | | |
|---|---|---|---|---|---|
| 1,614,948 | A | * | 1/1927 | Danks | 122/302 |
| 2,202,768 | A | * | 5/1940 | Bailey | 122/478 |
| 2,575,885 | A | * | 11/1951 | Mittendorf | 122/479.1 |
| 2,625,138 | A | * | 1/1953 | Jacoby | 122/14.22 |
| 2,890,862 | A | | 6/1959 | Heller | |
| 3,154,140 | A | * | 10/1964 | Esselman et al. | 165/104.22 |
| 3,997,001 | A | | 12/1976 | Chubb | |
| 5,083,537 | A | * | 1/1992 | Onofrio et al. | 123/195 R |
| 5,127,381 | A | * | 7/1992 | Kupzik et al. | 123/467 |
| 5,146,878 | A | * | 9/1992 | Hulkkonen | 122/510 |
| 6,167,845 | B1 | * | 1/2001 | Decker, Sr. | 122/40 |
| 7,258,317 | B1 | * | 8/2007 | Nagel | 248/244 |
| 7,478,648 | B2 | * | 1/2009 | Lundgren | 138/31 |

FOREIGN PATENT DOCUMENTS

| | | | | | |
|---|---|---|---|---|---|
| FR | 813 885 | A | | 6/1937 | |
| FR | 1 308 703 | A | | 11/1962 | |
| GB | 2 127 517 | A | | 4/1984 | |
| GB | 2127517 | A | * | 4/1984 | F28G 1/04 |
| JP | 57 077898 | A | | 5/1982 | |
| WO | WO2005075919 | | * | 2/2005 | F28F 1/32 |
| WO | WO 2005/075919 | A | | 8/2005 | |

* cited by examiner

*Primary Examiner* — Steven B McAllister
*Assistant Examiner* — Ko-Wei Lin
(74) *Attorney, Agent, or Firm* — Jackson Patent Law Office

(57) ABSTRACT

Heat exchanger for thermo boiler 1 with a tube bundle 6 using solid fuel in particles constituted from an inner furnace 7 and a double wall jacket connected from the tube bundle 6 characterized by the fact that space 14 over the inner furnace 7 and the tube bundle 6 is divided from a slab 13, that tubes 6 which cross said slab 13 in openings 15 are rigidly fixed to said slab 13, that at least a bar 10, 11 which can be controlled from outside crosses the slab 13 and the double wall jacket 20 on at least one side, that said bar/s 10, 11 bring/s at least two scraping plates 8 and 9, of which an at least intermediate one positioned on one side of said slab 13 and at least an other one from the opposite part of slab 13, of which at least one positioned at the end of tubes 6.

6 Claims, 1 Drawing Sheet

HEAT EXCHANGER FOR THERMO BOILER

TECHNICAL FIELD OF THE INVENTION

The present invention concerns the realization of a heat exchanger for thermo boiler using solid fuel in particles with tube bundle in copper, steel or other suitable material provided with a tube scraper and at least double circulation of the combustion smoke for production of hot water, for domestic heating as well as for high efficiency sanitary usage with maintenance facility.

STATE OF THE ART

The use of fuel made up of wood material is very wide spread and has led to the construction of boilers that heat warm water are for heating as well as for sanitary warm water, defined thermo boilers.

In the thermo boilers currently on the market when the heat exchangers encrust by the combustion smoke (creosote and other) the cleaning operations must be executed by hand. These operations are difficult to execute and must be carried out when the boiler is off in order to avoid risks for workers. Such operations request specialised workforce and cleaning operations, after the guarantee period is expired, are at user's expences with a remarkable cost enhancing, if it is executed, or with a situation of fire danger if soot is being accumulated on the tubes.

Patent application GB-2185095 describes a thermo boiler in which the double-wall jacket is realized with a zigzag plate to constrain the smokes to flow over the plate folds and a deflector, containing as many fins as the plate folds are is installed, into a furnace. In this case the realization is complicated and therefore has elevated costs and the efficiency is not high because the surface of thermical exchange produced is not large.

The Italian Patent Application CZ2004A000002 presents a system that concurs to scrape the tubes of a heat exchanger, through the use of two fins that slide on the tubes and one of said fins constitutes a baffle plate for the combustion smoke, which is forced first to go upwards and then downwards. Such solution introduces various orders of difficulty.

Since the intermediate fin must act as a baffle plate, the tubes must be inserted in the openings present in said fin without clearance, and therefore the sliding between intermediate fin and tubes is very difficult.

If the intermediate fin does not realize a perfect contact with the inferior baffle plate combustion smokes going back find a section larger than the section from which they must come down, and this creates a decrease of efficiency of the thermo boiler.

Moreover the two fins, for the fact that the tubes must be inserted in the openings present in the fins without clearance, cannot rotate around an other point as there not are other points on which the connecting rods rest.

The present invention aims to overcome the difficulties and disadvantages present in actually commerced technical solutions.

A principal scope of the present invention is to realize a heat exchanger for thermo boiler with a tube bundle using solid fuel in particles constituted from an inner furnace and a double wall jacket connected from the tube bundle characterized by the fact that space over the inner furnace and the tube bundle is divided from a slab, that tubes which cross said slab in openings are rigidly fixed to said slab, that at least a bar which can be controlled and moved from outside crosses the slab and the double wall jacket on at least one side, that said bar/s bring/s at least two scraping plates, of which an at least intermediate one positioned on one side of said slab and at least an other one from the opposite part of slab, of which at least one positioned at the end of tubes.

Other characteristic is given from the fact that the plates are placed at least one from the side in which bar/s are controlled and at least an other one at the opposite end of the tubes.

Other characteristic is given from the fact that the slab is composed from an inferior part tilted and from an upper part perpendicular to tubes which are crossed from said tubes.

Other characteristic is given from the fact that the upper part of the slab crossed from tubes presents bendings on the sides apt to receive the intermediate scraping plate.

Other characteristic is given from the fact that bars are moved from outside and are two.

Other characteristic is given from the fact that the bar/s are moved through a handle.

Other characteristic is given from the fact that the bars pass inside the double wall jacket through two sleeves.

Other characteristic is given from the fact that the scraping plates are two and one of them is an intermediate plate placed from the side from which bar/s are moved before slab and an other one is placed from the opposite part of slab at the end of tubes.

Other characteristic is given from the fact that in the tube bundle one or more tubes for air heating are inserted.

Other characteristics and advantages of invention will be clear from the following description of the invention given as a not limiting example on FIG. 1. from FIGS. 1 and 2.

DETAILED DESCRIPTION OF THE PRESENT INVENTION

Figure 1:
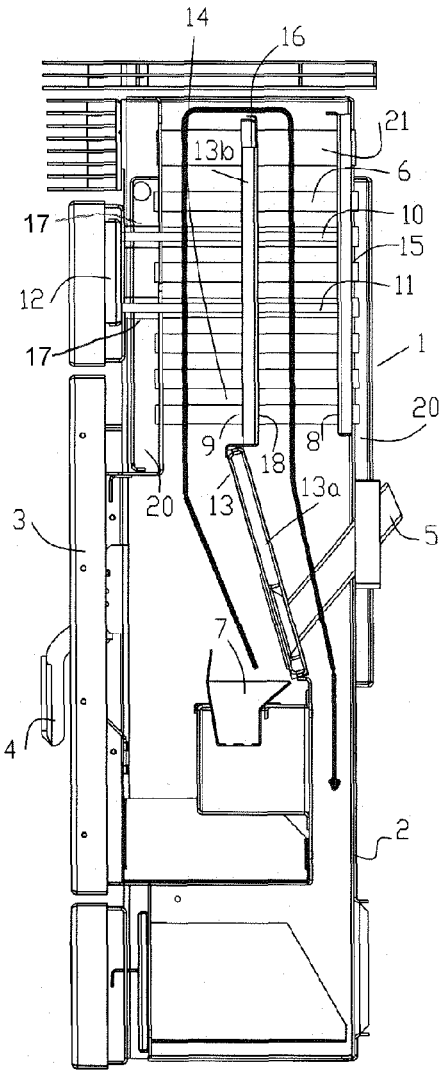
FIG. 1 represents a section of a thermo boiler in which the heat exchanger, object of the present invention, shows the scraping plates in rest position.
Figure 2:
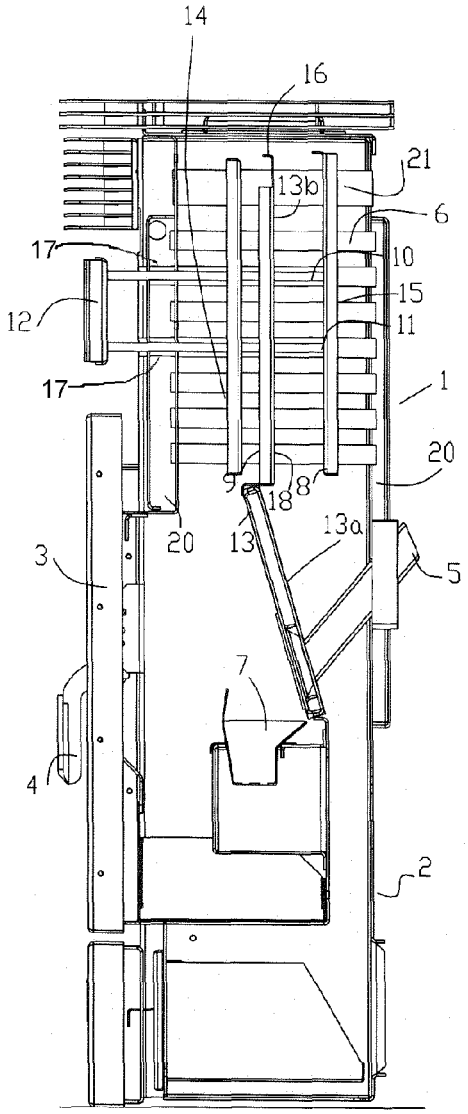
FIG. 2 represents a section of a thermo boiler in which the heat exchanger, object of the present invention, shows the scraping plates in work position.

Making reference to FIGS. 1 and 2, a thermo boiler 1 is constituted by an external casing 2, equipped of a door 3, with an opening handle 4.

Inside the external casing 2 a furnace 7 is placed that is fed of solid fuel in particles through the conduct 5. The solid fuel in particles coming from conduct 5 falls in the furnace 7, where, in presence of air, the combustion happens. On the furnace 7 a heat exchanger with tube bundle 6 in copper, steel or other suitable material. is placed. Tubes 6 connect the double wall jacket 20 realized in the thermo boiler 1, shown in the upper part of said thermo boiler 1, in FIGS. 1 and 2.

On tubes 6 at least two scraping plates 8 and 9 are mounted sliding on said tubes that cross said plates in openings 15 present on them, in FIGS. 1 and 2 an end plate 8 and an intermediate plate 9, which are connected from at least a bar 10, in the FIGS. 1 and 2 two bars 10 and 11, joined with a handle 12, that, through its action, moves the bar/s 10, 11 and therefore plates 8, 9. In order to cross the double wall jacket 20 bars 10 and 11 pass through sleeves 17. Plates 8 and 9 have openings 15 in which tubes 6 are inserted. Space 14 over the combustion chamber and tube bundle 6 is divided from a slab 13, slab 13 is rigidly fixed to tubes 6, as an example tubes 6 are forced with pressure in the openings 18 of slab 13, or said tubes 6 can be welded to said slab 13.

Slab 13 has a lower part tilted 13*a* and an upper part 13*b*perpendicular to tubes 6 and is crossed from them. The part of superior slab 13*b*perpendicular to tubes 6 presents a bending 16 on all four sides. The intermediate scraping plate 9, in rest position, strikes against the part of slab 13*b* perpendicular to tubes 6 and joins the bending 16 in said part of superior slab 13*b* perpendicular to tubes 6.

Due to the presence of slab 13, the combustion smokes are forced to go upwards along the tube bundle 6 from one side and to go downwards from the opposite part flowing along the tubes 6 at least two times, when they go up and when they go down.

In this way the thermal exchange between combustion smokes and copper tubes is enhanced with significant increasing of efficiency. Besides, copper tubes 6 can be easily cleaned of eventual creosote traces formed on them, by pulling forward and backward handle 12 and making fall the soot on furnace 7, thereby resulting in increasing of efficiency of thermo boiler 1, and making the cleaning of tube beam 6 easier.

The cleaning action of the tube bundle of a thermo boiler is, in this way, particularly efficient, because if one pulls upwards the handle 12, the system composed from handle 12, bar/s 10 and 11, intermediate plate 9 and end plate 8 is forced to rotate around the point of contact of the slab 13*b* with bar/s 10 and 11, for which the end plate 8 of the thermo boiler cleans the upper surface of the posterior portion of tubes 6 and intermediate plate 9 cleans the lower surface of the anterior portion of tubes 6.

If, instead the handle is pulled downwards, the system composed from handle 12, bar/s 10 and 11, intermediate plate 9 and end plate 8 is always forced to rotate around the point of contact of the slab 13*b* with bar/s 10 and 11, for which the end plate 8 of the thermo boiler cleans up the lower surface of the posterior portion of tubes 6 and intermediate plate 9 cleans up the upper surface of the anterior portion of tubes 6.

Finally, in the upper part of the heat exchanger one or more tubes are inserted for air circulation 21, which can have a fan in order to increase the circulated air volume. The presence of these tubes is useful in order to increase efficiency, as they recover the heat at low temperature and they introduce it in the room.

Obviously, the invention, is not limited to the representation delivered on the figures and can be improved by a person of skill in the art without departing from the patent scope.

The present invention allows attainment of numerous overcomes and overcome the difficulties that could not be overcome with systems actually in commerce.

The invention claimed is:

1. A heat exchanger for a thermo boiler using solid fuel in particles, the heat exchanger comprising:

a tube bundle including a plurality of tubes;

a furnace; and a double wall jacket connected to the tube bundle, wherein the heat exchanger defines a space over the furnace, and the heat exchanger further includes a slab dividing the space and the tube bundle, the slab defining openings, and the tubes of the tube bundle traversing the slab via the openings, the tube bundle being rigidly fixed to the slab, the slab defining a longitudinal dimension extending away from the furnace such that combustion smoke is forced to go upwards along the tube bundle on a side of the slab and to go downwards on an opposite side of the slab, thus flowing along the tube bundle two times, the slab including a lower part and an upper part, the upper part being perpendicular to the tubes and traversed by the tubes;

a first scraping plate, the first scraping plate being positioned on a first side of the slab;

a second scraping plate, the second scraping plate being positioned on a second side of the slab, the second side being opposite the first side;

a bar controllable from outside the heat exchanger, the bar traversing the slab and a side of the double wall jacket, the bar being configured to move the first and second scraping plates.

2. A heat exchanger according to claim 1 characterized by the fact that an upper part of the slab includes crossed bendings adapted to receive one of the scraping plates.

3. A heat exchanger according to claim 1 further including a second bar controllable from outside the heat exchanger, the second bar traversing the slab and the side of the double wall jacket, the second bar being configured to move the first and second scraping plates.

4. A heat exchanger according to claim 1 further including a handle configured to move the bar.

5. A heat exchanger for according to claim 1 further including a sleeve, wherein the bar passes inside the double wall jacket through the sleeve.

6. A heat exchanger according to claim 1 characterized by the fact that in the tube bundle a tube for air heating is inserted.

* * * * *